US008935940B1

(12) United States Patent
Lough

(10) Patent No.: US 8,935,940 B1
(45) Date of Patent: Jan. 20, 2015

(54) KEYCHAIN BRACELET

(71) Applicant: Holly Lough, Lafayette, IN (US)

(72) Inventor: Holly Lough, Lafayette, IN (US)

( * ) Notice: Subject to any disclaimer, the term of this patent is extended or adjusted under 35 U.S.C. 154(b) by 0 days.

(21) Appl. No.: 14/059,627

(22) Filed: Oct. 22, 2013

(51) Int. Cl.
*A44C 13/00* (2006.01)
*A44C 5/00* (2006.01)
*F41H 9/10* (2006.01)

(52) U.S. Cl.
CPC ..... *F41H 9/10* (2013.01); *A44C 5/0007* (2013.01)
USPC ..... 63/1.12; 63/1.11; 63/1.14; 63/3.1

(58) Field of Classification Search
CPC .. A44C 5/0007; A44C 5/0038; A44C 5/0053; A44C 25/00
USPC ..... 63/1.12, 1.14, 1.16, 3.1, 5.1; D11/3, 7, D11/86
See application file for complete search history.

(56) References Cited

U.S. PATENT DOCUMENTS 618,561 A * 1/1899 Crandall ..... 70/46
645,874 A * 3/1900 Smith ..... 70/20
665,630 A * 1/1901 Crandall ..... 70/53
776,256 A * 11/1904 Perkins ..... 63/1.14
3,124,286 A * 3/1964 Dompier ..... 224/255
4,159,792 A 7/1979 Siegal
4,236,384 A * 12/1980 Daub ..... 63/7
D292,144 S 10/1987 McClure
4,760,715 A * 8/1988 Ramos, Jr. ..... 63/5.2
4,982,641 A 1/1991 Duhard
5,134,862 A * 8/1992 Giehl ..... 63/23
5,358,144 A 10/1994 Mock
D390,000 S * 2/1998 Savas ..... D3/208
6,050,119 A 4/2000 Potts
6,860,049 B2 * 3/2005 Bagnara ..... 40/634
D513,392 S * 1/2006 Arbore ..... D11/48

* cited by examiner

*Primary Examiner* — Emily Morgan
(74) *Attorney, Agent, or Firm* — Kyle A. Fletcher, Esq.

(57) ABSTRACT

The keychain bracelet is constructed of a flexible member that includes a plurality of charm members thereon, and which can stretch to enable a wrist to be inserted or removed as needed. The flexible member has distal ends that are permanently affixed to a padlock member, and which is configured to secure at least one keychain thereon as well as a self-defense repellent spray such as pepper spray. The self-defense repellent spray includes a small canister that when affixed to the padlock member ideally positions itself with respect to a palm of a hand of an end user. The padlock member features a light emitting diode and pill compartment to store at least one pill therein. The flexible member includes a key elsewhere with respect to the padlock member. The key is used to unlock the padlock member.

11 Claims, 3 Drawing Sheets

KEYCHAIN BRACELET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of bracelets, more specifically, a bracelet that includes a small padlock that is configured to attach to a keychain.

SUMMARY OF THE INVENTION

An embodiment of the disclosure meets the needs presented above by generally comprising a bracelet that is constructed of a flexible member that includes a plurality of charm members thereon, and which can stretch to enable a wrist to be inserted or removed as needed. The flexible member has distal ends that are permanently affixed to a padlock member, and which is configured to secure at least one keychain thereon as well as a self-defense repellent spray such as pepper spray. The self-defense repellent spray includes a small canister that when affixed to the padlock member ideally positions itself with respect to a palm of a hand of an end user. The padlock member features a light emitting diode and pill compartment to store at least one pill therein. The flexible member includes a key elsewhere with respect to the padlock member. The key is used to unlock the padlock member.

An object of the invention is to provide a bracelet that is able to stretch in order to easily be placed or removed from a wrist of an end user.

A further object of the invention is for the invention to include a small padlock that locks and unlocks in order to attach at least one key ring or keychain and/or self-defense spray repellent.

An even further object of the invention is for the self-defense spray repellent to be ideally positioned in order to easily grasp from the palm of the hand of an end user.

An even further object of the invention is for a key to be located elsewhere on the bracelet, which is used to unlock the padlock.

Another object of the invention is for the padlock to include a pill storage compartment.

Another object of the invention is for the padlock to include a light emitting diode to assist in an end user in a poorly lit locale.

These together with additional objects, features and advantages of the keychain bracelet will be readily apparent to those of ordinary skill in the art upon reading the following detailed description of presently preferred, but nonetheless illustrative, embodiments of the keychain bracelet when taken in conjunction with the accompanying drawings.

In this respect, before explaining the current embodiments of the keychain bracelet in detail, it is to be understood that the keychain bracelet is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the keychain bracelet.

It is therefore important that the claims be regarded as including such equivalent construction insofar as they do not depart from the spirit and scope of the keychain bracelet. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
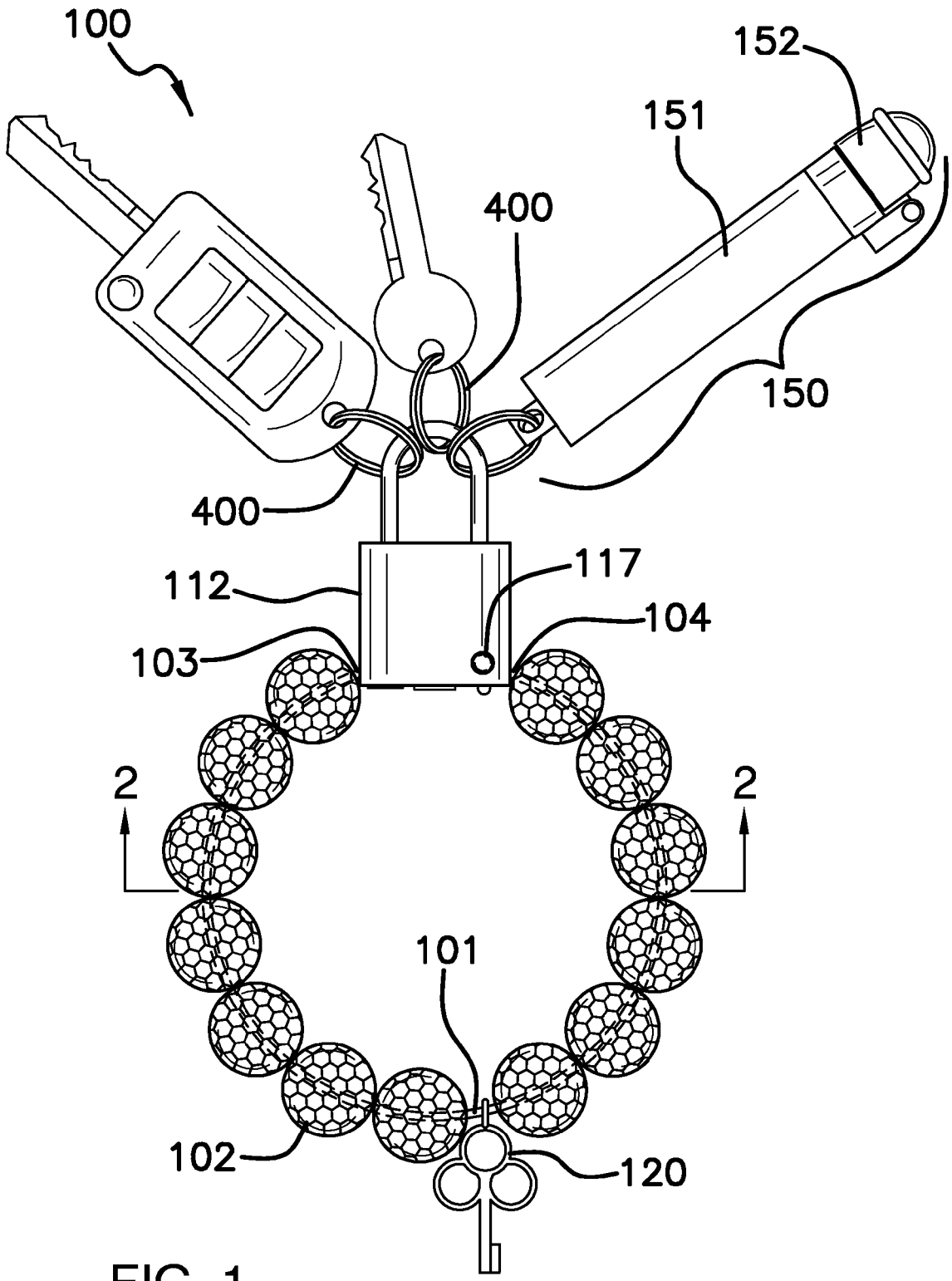
FIG. 1 is a front view of the keychain bracelet.
Figure 2:
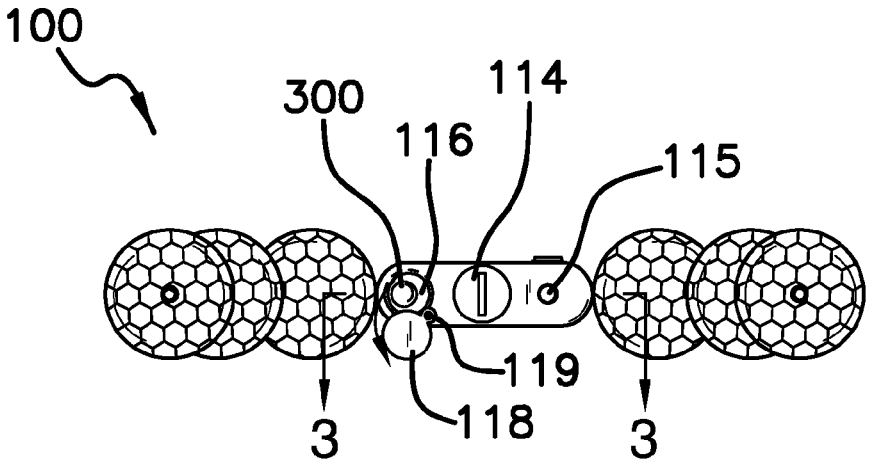
FIG. 2 is a cross-sectional view along line 2-2 in FIG. 1, and depicting the bottom surface of the padlock.
Figure 3:
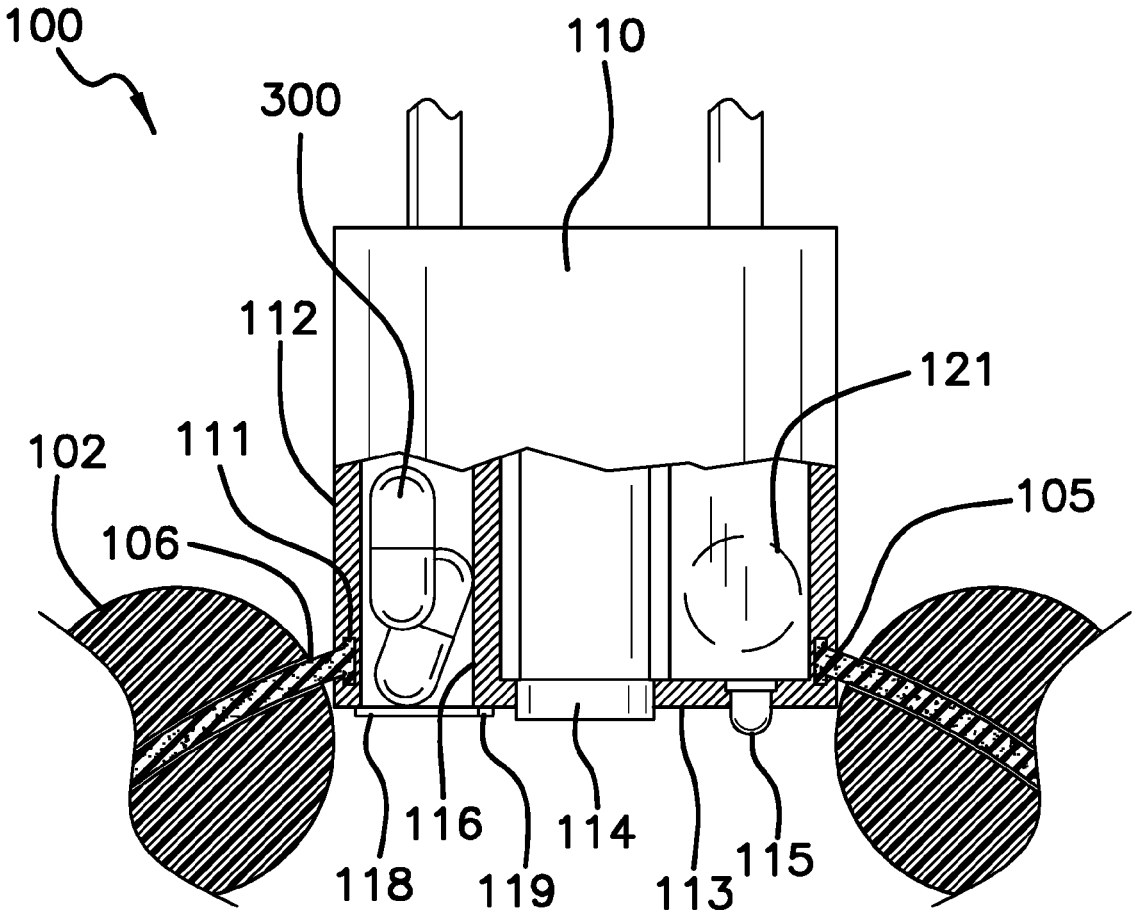
FIG. 3 is a cross-sectional view along line 3-3 in FIG. 2, and depicting the pill compartment and light emitting diode with respect to the padlock.
Figure 4:
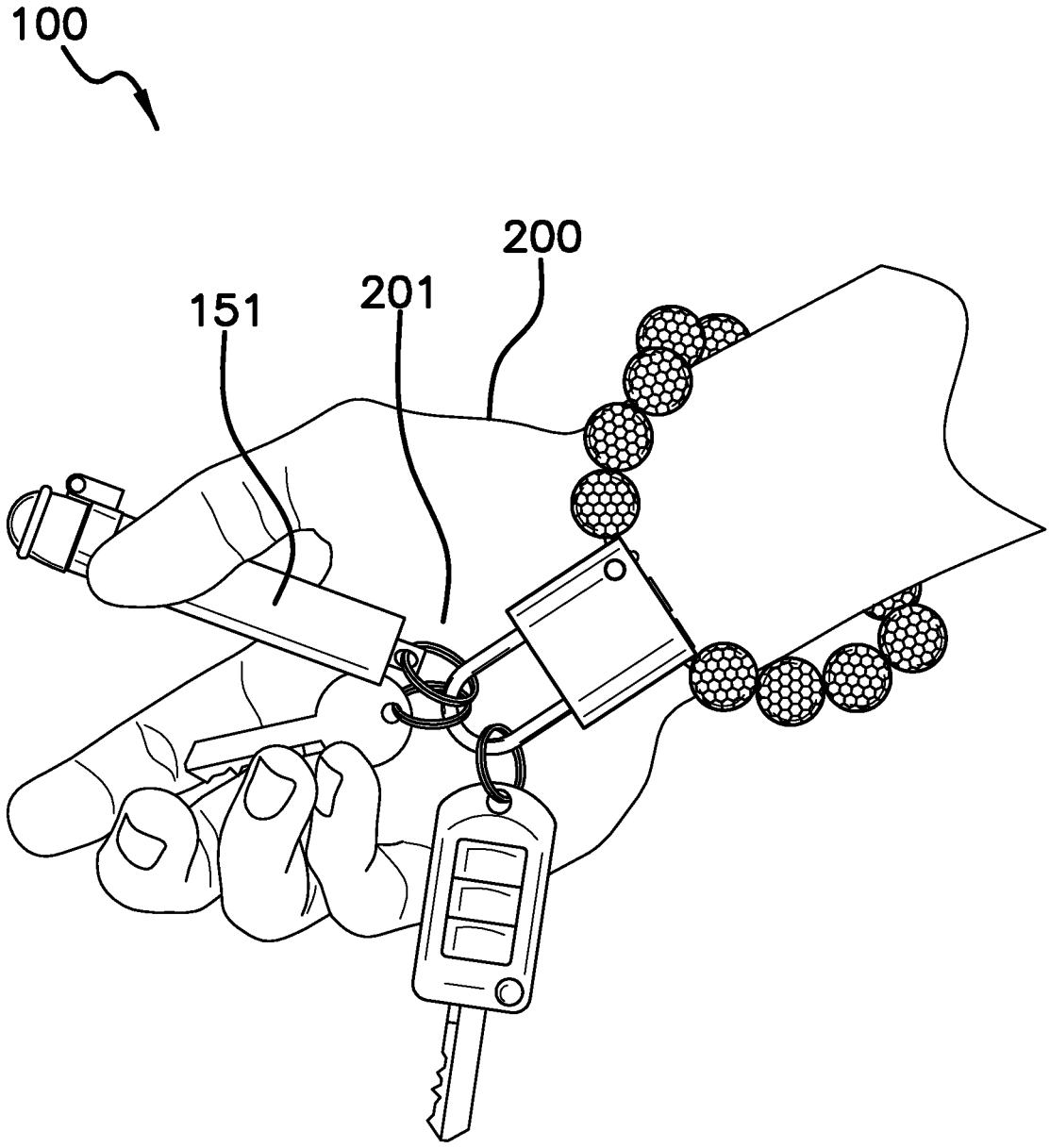
FIG. 4 is a view of the keychain bracelet in use, and depicting a hand grasping the self-defense spray repellent canister.

As best illustrated in FIGS. 1 through 4, the keychain bracelet 100 (hereinafter invention) is further comprised of a flexible member 101 that includes a plurality of charm members 102 thereon. The flexible member 101 is further defined with a first distal end 103 and a second distal end 104. Both the first distal end 103 and the second distal end 104 attach to a padlock member 110. Moreover, both the first distal end 103 and the second distal end 104 include a lipped protuberance 105, which is seated inside of a padlock member cavity 111. The padlock member cavity 111 is located on opposing side surfaces 112 of the padlock member 110. The flexible member 101 is of no particular length, and is able to stretch in order for a wrist 200 of an end user to be inserted and removed as needed.

The charm members 102 each include a hole 106, which enables the charm member 102 to be threaded onto the flexible member 101. The flexible member 101 includes a key 120 that is also threaded on the flexible member 101, and which is used to unlock the padlock member 110. The padlock member 110 is positioned opposite of the key 120. The padlock member 110 is further defined with a bottom surface 113, which includes a key-hole 114 thereon as well as a light emitting diode 115, and a pill compartment 116. The light emitting diode 115 is turned on/off upon depression of a light button 117 located elsewhere on the padlock member 110. The pill compartment 116 includes a pill compartment door 118 that is rotatably engaged with respect to a pivot hinge 119. The pill compartment door 118 rotates to expose the pill compartment 116, which is configured to store at least one pill 300 therein. The light button 117 is in wired communication with a battery 121 located inside of the padlock member 110.

The padlock member 110 unlocks in order to secure or remove at least one keychain 400 therefrom and/or a self-defense spray repellent 150. The self-defense spray repellent 150 may involve the use of a pepper spray or a MACE liquid that is sprayed in order to repel a would-be attacker. The self-defense spray repellent 150 includes a canister 151 of an undefined length, which includes a hinged cap 152 that rotates to expose a nozzle that is depressed to release the contents. The canister 151 is ideally located on the invention 100 to provide ease of use in grasping via a palm 201 of the hand 200.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A keychain bracelet comprising:

a flexible member having a plurality of charm members thereon;

a padlock member attaches to a first distal end and a second distal end of the flexible member;

wherein the padlock member is unlocked via a key in order to adaptively remove or secure at least one keychain;

wherein the padlock member is also able to unlock for removal of or securement of a self-defense spray repellent that is ideally positioned for access of a palm of a hand;

wherein the first distal end and the second distal end of the flexible member each include a lipped protuberance, the padlock member includes two padlock member cavities, each lipped protuberance is seated inside a corresponding one of the two padlock member cavities;

wherein the padlock member cavities are located on opposing side surfaces of the padlock member; wherein the flexible member is of no particular length, and is able to stretch in order for a wrist to be inserted and removed as needed;

wherein the charm members each include a hole, which enables the charm member to be threaded onto the flexible member; wherein the flexible member includes the key that is also threaded on the flexible member, and which is used to unlock the padlock member; wherein the padlock member is positioned opposite of the key.

2. The keychain bracelet according to claim 1 wherein the padlock member is further defined with a bottom surface, which includes a key-hole thereon as well as a light emitting diode, and a pill compartment.

3. The keychain bracelet according to claim 2 wherein the light emitting diode is turned on/off upon depression of a light button located elsewhere on the padlock member.

4. The keychain bracelet according to claim 3 wherein the pill compartment includes a pill compartment door that is rotatably engaged with respect to a pivot hinge; wherein the pill compartment door rotates to expose the pill compartment, which is configured to store at least one pill therein.

5. The keychain bracelet according to claim 4 wherein the light button is in wired communication with a battery located inside of the padlock member.

6. The keychain bracelet according to claim 5 wherein the self-defense spray repellent includes a canister of an undefined length, which includes a hinged cap that rotates to expose a nozzle that is depressed to release the contents of the canister.

7. A keychain bracelet comprising:

a flexible member having a plurality of charm members thereon;

a padlock member attaches to a first distal end and a second distal end of the flexible member;

wherein the padlock member is unlocked via a key in order to adaptively remove or secure at least one keychain;

wherein the padlock member is also able to unlock for removal of or securement of a self-defense spray repellent that is ideally positioned for access of a palm of a hand;

wherein the first distal end and the second distal end of the flexible member each include a lipped protuberance, the padlock member includes two padlock member cavities, each lipped protuberance is seated inside a corresponding one of the two padlock member cavities;

wherein the padlock member cavities are located on opposing side surfaces of the padlock member; wherein the flexible member is of no particular length, and is able to stretch in order for a wrist to be inserted and removed as needed;

wherein the charm members each include a hole, which enables the charm member to be threaded onto the flexible member; wherein the flexible member includes the key that is also threaded on the flexible member, and which is used to unlock the padlock member; wherein the padlock member is positioned opposite of the key;

wherein the padlock member is further defined with a bottom surface, which includes a key-hole thereon as well as a light emitting diode, and a pill compartment.

8. The keychain bracelet according to claim 7 wherein the light emitting diode is turned on/off upon depression of a light button located elsewhere on the padlock member.

9. The keychain bracelet according to claim 8 wherein the pill compartment includes a pill compartment door that is rotatably engaged with respect to a pivot hinge; wherein the pill compartment door rotates to expose the pill compartment, which is configured to store at least one pill therein.

10. The keychain bracelet according to claim 9 wherein the light button is in wired communication with a battery located inside of the padlock member.

11. The keychain bracelet according to claim 10 wherein the self-defense spray repellent includes a canister of an undefined length, which includes a hinged cap that rotates to expose a nozzle that is depressed to release the contents of the canister.

* * * * *